US005423415A

United States Patent [19]

Williams

[11] Patent Number: 5,423,415

[45] Date of Patent: Jun. 13, 1995

[54] SURFACE ASSEMBLY FOR ROPE PUMPS

[75] Inventor: Mark S. Williams, Evergreen, Colo.

[73] Assignee: Red Top Pump Co., Ltd., Evergreen, Colo.

[21] Appl. No.: 120,185

[22] Filed: Sep. 13, 1993

[51] Int. Cl.[6] ..... B65G 15/00

[52] U.S. Cl. ..... 198/643

[58] Field of Search ..... 198/643

[56] References Cited

U.S. PATENT DOCUMENTS

| | | | |
|---|---|---|---|
| 930,465 | 8/1909 | Fowler | 198/496 |
| 1,017,847 | 2/1912 | Carl | 198/643 X |
| 1,703,963 | 3/1929 | Scruby | 198/643 X |
| 1,740,821 | 12/1929 | Kneuper | 198/643 X |
| 2,121,931 | 6/1938 | Sloan | 198/643 X |
| 2,289,706 | 7/1942 | Hay et al. | 198/643 |
| 2,329,913 | 9/1943 | Kizziar | 198/643 X |
| 2,380,144 | 7/1945 | Bohannon | 198/643 X |
| 2,704,981 | 3/1955 | Gustafson | 198/643 X |
| 3,774,685 | 11/1973 | Rhodes | 198/643 X |
| 4,652,372 | 3/1987 | Threadgill | 210/242.3 |
| 4,712,667 | 12/1987 | Jackson et al. | 198/643 |
| 5,048,670 | 9/1991 | Crafton et al. | 198/643 |
| 5,080,781 | 1/1992 | Evins, IV | 198/643 X |

*Primary Examiner*—Cheryl L. Gastineau
*Attorney, Agent, or Firm*—Swanson & Bratschun

[57] ABSTRACT

A rope pump for conveying fluid-like material from a reservoir to a select location includes an endless rope, pulleys for forming the endless rope into a loop extending between the reservoir and the select location and an improved drive for driving the endless rope about the pulleys. The improved drive includes first and second sheaves each having a plurality of circumferencial grooves and an axis of rotation. The first and second sheaves are mounted to shafts for rotation about their respective axes of rotation. The sheaves are radially spaced with the grooves of the first sheave aligned with the grooves of the second sheave and the respective axes of rotation being in parallel. A motor is provided in operative association with one of the first and second sheaves for rotating the sheave about its axis. The endless rope is wrapped between the first and second sheaves with the rope extending between and engaging aligned grooves and adjacent grooves a select number of times to provide a selective tractive force. A biased tensioner wheel biases the rope to maintain the rope in constant engagement with the final rope engaging groove of the first and second sheaves.

17 Claims, 4 Drawing Sheets

SURFACE ASSEMBLY FOR ROPE PUMPS

BACKGROUND OF THE INVENTION

1. Technical Field

This invention relates to improvements in fluid pumping technology, and particularly to the area of pumping fluids from boreholes using rope pumps.

2. Background of the Invention

Prior art representative of this general type of pump is found in these U.S. Pat. Nos.: Fowler (930,465), Carl (1,017,847), Scruby (1,703,963), Kneuper (1,740,821), Sloan (2,121,931), Hay (2,289,706), Kizziar (2,329,913), Bohannon (2,380,144), Gustafson (2,704,981), Rhodes (3,774,685), Threadgill (4,652,372), Jackson (4,712,667), and Crafton (5,048,670).

Use of a continuous flexible member moving about an upper (surface) and a lower (submerged) sheave as a means to pump fluids has been documented in the United states patents as early as 1908. Although the early inventors were not completely knowledgeable of the physics involved, they clearly used Couette flow and other advanced fluid mechanics theories to their advantage. These devices are known as "rope pumps".

Rope pump technology holds great promise, provided certain technical aspects of the machinery can be refined. None of the prior patents has resulted in a commercial product. Previous patentees have failed to adequately address the issues of tractive effort, high-speed operation, corrosive wellbore environments, power transmission requirements, fluid movement at the surface, high-pressure applications, and designs which would lend themselves to long-term, maintenance-free operation. None has addressed the issues of command and control.

SUMMARY OF THE INVENTION

The present invention represents a number of improvements to the surface equipment portion of the rope pump devices. The improvements are incorporated into a mechanical unit. The present invention improves the usefulness and efficacy of rope pumps in general, and specifically addresses those things necessary to make a commercially competitive product. Those improvements are:

a) double drive sheave arrangement with tensioner,
b) removable-cover to form a containment vessel,
c) externally mounted power transmission components,
d) pressure seals for high-pressure applications,
e) integrated collection reservoir, and
f) integrated wellhead connection.

The double drive sheave arrangement with tensioner provides an extremely powerful means for pulling the rope up at high speeds. The rope is wrapped around two multi-grooved drive sheaves, one of which is powered. The tensioner, operating in tandem with a slightly oversized outer groove on the lower drive sheave, provides constant positive tension of the rope on the drive sheaves, and allows the double drive sheaves to continuously eliminate rope slack.

A containment vessel is formed when the front cover is bolted to the top frame. The front cover seals against the top frame by means of a bolt flange and gasket arrangement. The purpose of the containment vessel is to confine and contain produced fluids and gases so they may be directed to the proper field plumbing. Workmen may easily access all internal parts by removing the front cover.

As a consequence of the removable front cover and top frame arrangement, most moving parts are located outside the containment vessel, where they are kept dry and ventilated for cooling, as necessary. By keeping the power transmission components outside of the containment vessel, they are easily serviced and should have a significantly improved useful life. They are also removed from a potentially explosive atmosphere. Power can be transmitted directly into the containment vessel by means of shafts that penetrate the containment vessel through high-pressure seals. This improvement is significant in that it eliminates gears, sprockets, chains, belts, hydraulics, and other intermediate forms of power transmission that have been used in other inventions.

Rope pumps, as a class, deliver fluids to the surface with virtually no pressure. As a consequence, a transfer pump is required to move produced fluids into flow lines or tanks. The present design incorporates a reservoir in which produced fluids can be collected. Float switches in the internal reservoir can actuate an external transfer pump that may be plumbed directly to the drainpipe connection on the bottom of the reservoir. This improvement eliminates the need for an external reservoir and the associated plumbing.

The entire surface unit is attached to the wellhead by means of a threaded coupling welded to the bottom of the reservoir. This coupling screws directly onto a standard tubing wellhead with no intermediate plumbing. This means the entire surface unit can be installed in a matter of minutes, with no plumbing connection.

By combining the wellhead coupling, reservoir, and containment vessel into a single, welded, surface unit, many of the complexities of prior designs are avoided. The entire surface unit can be assembled and tested in a manufacturing facility and then transported, in tact, as a single piece to the well. This single piece of equipment can then be installed in a single procedure lasting only a few minutes. The entire surface assembly will reside above the wellhead, with no footprint on the ground.

DETAILED DESCRIPTION OF THE PREFERRED EMBODIMENT

Figure 2:
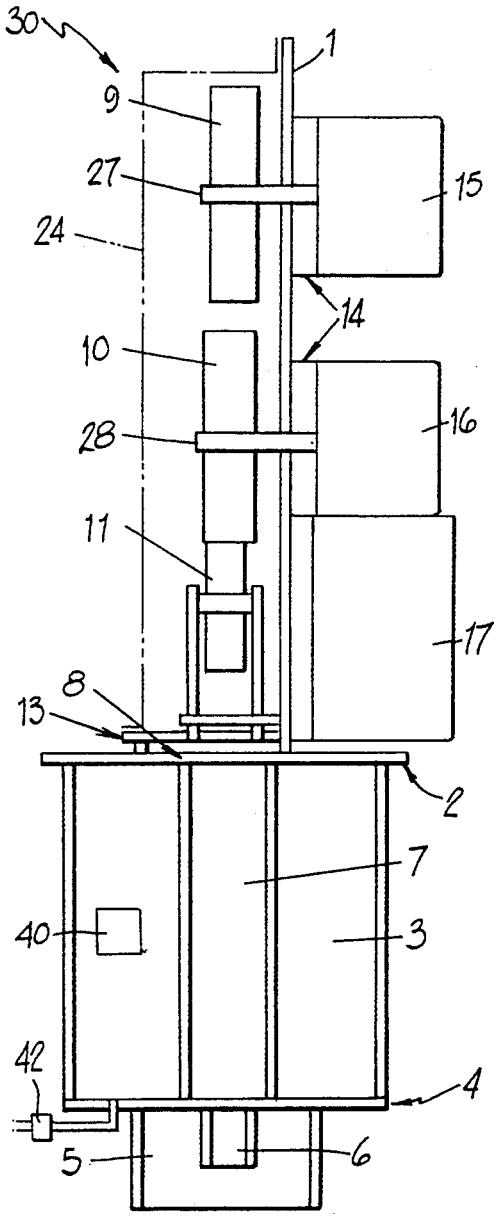
FIG. 2 is a schematic side view of a fully assembled unit with the front cover shown in phantom lines.

In all rope pumps, a mechanical device pulls the rope up out of the well and allows it to fall, by gravity, back into the well. The rope-pulling mechanism must have sufficient tractive effort to overcome the combined downward loads on the rope. Those downward loads are a function of: the diameters of rope and tubing, the viscosity of the fluids being pumped, the speed of the rope, the weight of the rope, the relative smoothness of the interior of the tubing, friction in the sheave or slide at the bottom of the tubing string, and the depth of the well.

In deep, high speed oil well applications, the drive sheaves must develop several hundred pounds of tractive effort and maintain that tractive effort when covered in oil. All previous designs lack the tractive effort necessary for deep, high speed applications. The current design easily provides sufficient tractive effort.

The present design employs two drive sheaves, an upper drive sheave (9) and a lower drive sheave (10), one positioned above the other. The drive sheaves have multiple grooves, specially angled to improve tractive effort. See FIGS. 1 and 2. The lower drive sheave (10) is attached to the output shaft (28) of the gearbox (16), which is located on the opposite side of the top frame (1). A hydraulic motor can be substituted for the gearbox (16). The upper drive sheave (9) is attached to the shaft of an overhung load adapter (15) located on the opposite side of the top frame (1). The shafts (27, 28) from both the gearbox (16) and the overhung load adapter (15) penetrate the top frame (1). Seal units (14) are used to keep fluids and gases on the inside of the containment vessel (30).

Figure 10:
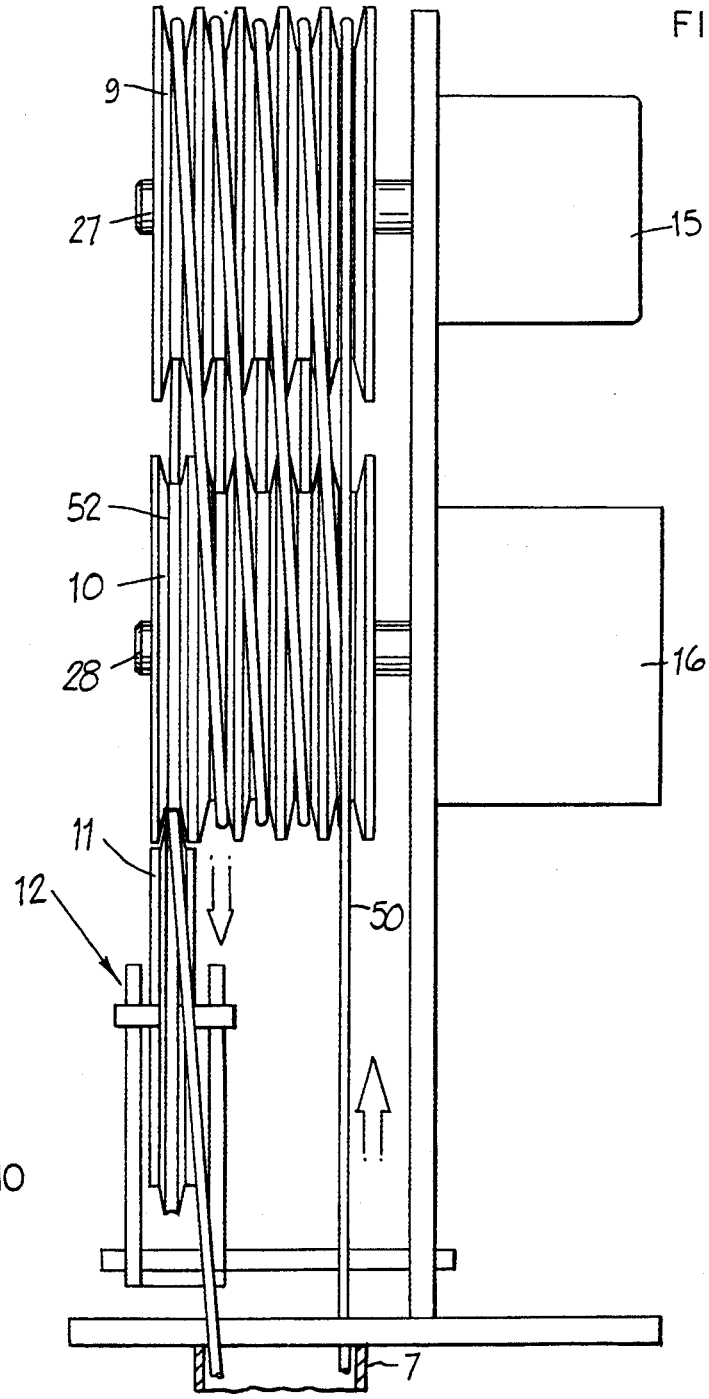
FIG. 10 is a front elevational view of the drive sheaves.

Referring to FIG. 10, the path of the rope (50) through the drive sheaves is as follows: vertically upward out of the riser (7) over the upper drive sheave (9) in the innermost groove, down and around the lower drive sheave (10) in the innermost groove, up and over the upper drive sheave (9) in the next groove, down and around the lower drive sheave (10) in the next groove, and so on until the rope goes down and halfway around the lower drive sheave (10) in the outermost groove, then over and around the tensioner wheel (11), and vertically down into the riser (7). The rope (50) is wound around and around the two drive sheaves in proportion to the tractive effort needed. The more traction necessary, the greater number of wraps about the drive sheaves. With each wrap, the tractive effort is multiplied. From tests, it would appear that no substantial advantage is gained by having more than five or six complete wraps about the drive sheaves, and five wraps is illustrated in FIG. 10.

The outer groove (52) on the lower drive sheave (10) is the last point of contact between the rope and either of the drive sheaves. That outer groove has a slightly larger diameter than all the rest. This results in a slightly longer circumference, which serves to place the rope in constant tension. This improvement assures the constant tension on the rope necessary for traction on the drive sheaves. It also allows the drive sheaves to constantly eliminate any slack in the rope.

A tensioner wheel (11) is positioned to contact the lower drive sheave (10) and to position the rope for the vertical drop into the down tube. The tensioner wheel (11) is forced into continuous contact with the lower drive sheave (10) by means of a spring (12) or, alternatively, an elastomer. The surface of the tensioner wheel (11) is of a durable material but with a soft durometer, to enable the tensioner to grip the rope. The tensioner wheel (11) ensures that the rope is placed in tension by the larger diameter of the outermost groove of the lower drive sheave (10). The tensioner wheel (11) also prevents slack in the downward bound rope from migrating upward into the drive sheaves (9) and (10).

Figure 5:
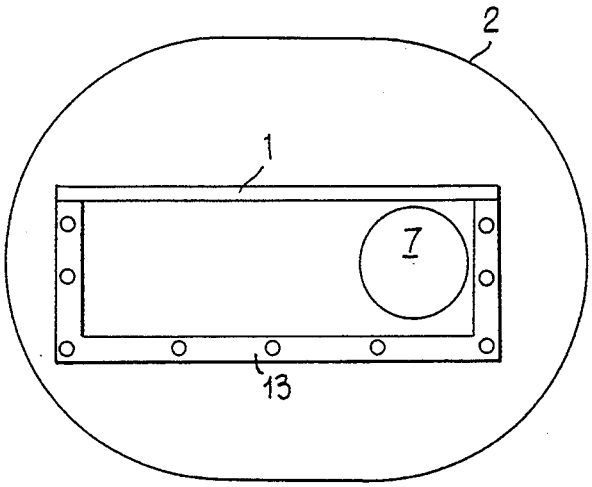
FIG. 5 is a top view of the top frame.
Figure 6:
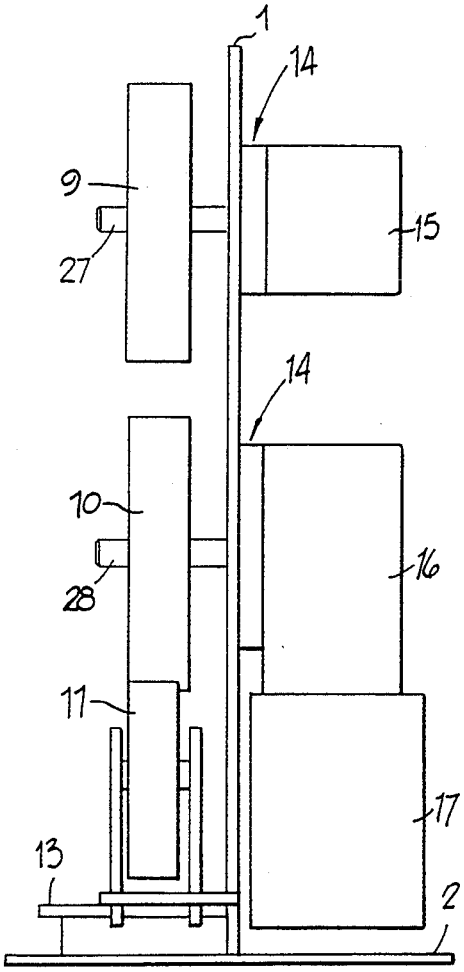
FIG. 6 is a side view of the top frame with the pumping mechanism in place and the front cover removed.

A containment vessel (30) is formed when the front cover (24) is bolted to the top frame (1). The front cover (24) seals against the top frame (1) by means of a bolt flange and gasket arrangement. See FIGS. 2, 5 and 7.

Figure 4:
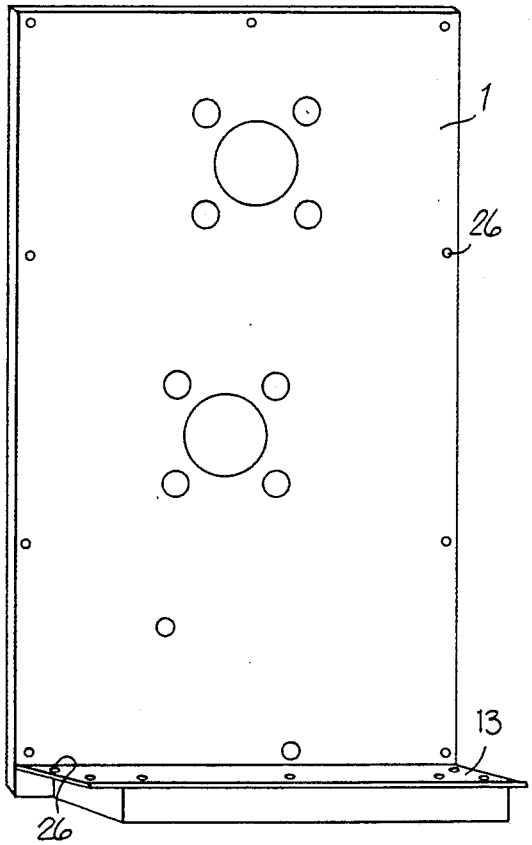
FIG. 4 is a perspective view of the top frame.
Figure 7:
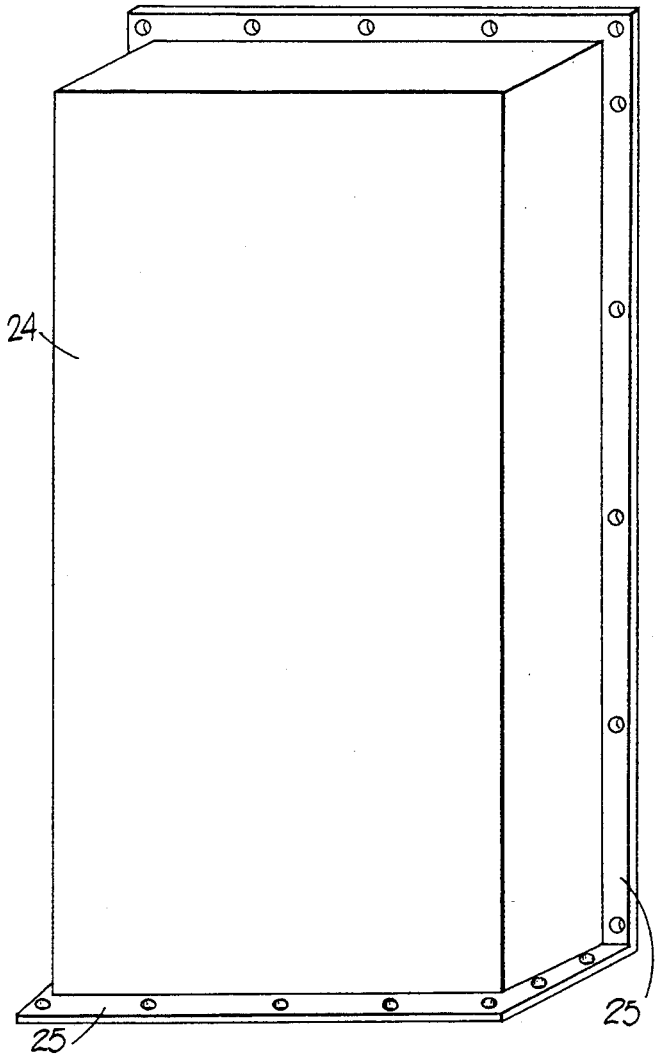
FIG. 7 is a perspective view of the front cover.
Figure 8B:
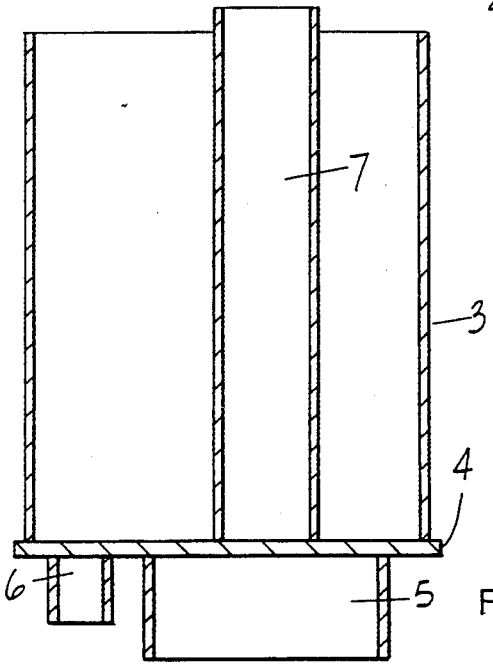
FIG. 8B is a side elevational sectional view of the base plate.
Figure 8A:
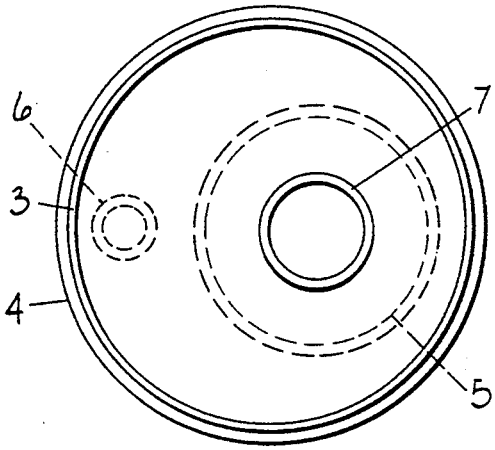
FIG. 8A is a plan view of the base plate.

As shown in FIG. 7, the front cover (24) is a rectangular metal box, with the back side and bottom removed. The exposed edges of the box are fitted with a bolt flange (25) having a plurality of holes in it spaced lengthwise. See FIGS. 2 and 4. The top surface of the top plate (2) has a bolt flange (13) welded to it, which matches the geometry of the bolt flange (25) on the bottom of the front cover (24). Both the bolt flange (13) and the perimeter of the top frame (1) have bolt holes (26) which match those in the bolt flange (25) on the front cover (24).

The containment vessel (30) and integral reservoir (3) seal the wellhead. All produced fluids and gasses are held inside the containment vessel (30) until they drain out the bottom drain (6) of the reservoir (3), or overflow back into the wellbore through the riser (7).

The only moving parts inside the containment vessel (30) are the drive sheaves (9, 10), tensioner wheel (11), and spring (12). The shafts (27, 28) on which the drive sheaves rotate, penetrate the top frame (1) from the back side. Seal units (14) on those shafts (27, 28) keep produced fluids and gasses inside the containment vessel (30).

The removable front cover (24) has many advantages: a) fewer total parts; b) opportunity to minimize the number of parts in the wet environment; c) easy access to parts inside the containment vessel (30), d) opportunity to locate the more expensive and sensitive parts outside the wet environment; and e) the motor (17) and other components are kept away from the potentially explosive environment inside the containment vessel (30).

For higher-pressure wells, the geometry of the front cover (24) would necessarily be changed to be more cylindrical. The inventor envisions that the rectangular front cover (24) would be replaced by one-half of a piece of heavy-walled pipe with one-half of a dome welded to the top of it. An appropriately shaped bolt flange would be welded to the pipe and dome halves. The bolt flange (13) on the top frame (1) would be changed to half-circle shape. The top frame (1) would be reinforced to resist the tendency to curve or bulge under great pressures.

The present design provides for the attachment of power transmission components to the outside of the top frame (1) (i.e., not inside the containment vessel (30)). See FIGS. 2, 3, 6 and 9. Gearbox (16) and the overhung load adapter (15) have shafts (27, 28) which penetrate the top frame (1), through seal units (14). As a result, these components will not be exposed to the produced fluids and gasses, which are often highly corrosive.

Previous patentees have used a variety of means for delivering power to the drive sheaves. Chains, sprockets, belts, pulleys, gears, and direct connections to motor shafts have been employed. Some have placed all or most of the mechanical parts in the harsh environment of the containment apparatus. Other have been of an "open air" style, which is not possible today for environmental reason.

The current invention requires that power be provided to only the lower drive sheave (10). To provide that power at the correct speed, the current invention utilizes a gearbox (16) and a variable speed electric motor (17). The lower drive sheave 910) is mounted on the output shaft (28) of the gearbox (16). No previous designs have employed a gear reduction system. The gearbox (16) and motor (17) are separated from the containment vessel (30) by shaft seal units (14) that prevent the movement of fluids or gases along the shaft.

The upper drive sheave (9) is an idler. The upper drive sheave (9) is affixed to a freely rotating shaft (27). The shaft (27) is supported by an overhung load adapter (15) mounted on the outside of the top frame (1). The shaft (27) extends from the overhung load adapter (15), through the top frame (1), and into the containment vessel (30). Seal units (14) on the shaft prevent fluids and gasses from escaping the containment vessel (30).

Having all power transmission components mounted to the outside of the top frame (1) is a significant improvement over previous designs. Operators can diagnose maintenance problems more easily and parts can be serviced without disturbing the containment vessel (30). Ambient air can be circulated around the power transmission components for cooling. Not shown in the drawings is a rain tight cover over the back of the top frame (1) that will protect the power transmission components from weather.

To accommodate high pressures found in some oil and gas wells, the current invention includes high pressure seal units (14). See FIGS. 2, 6, 9A and 9B. The seal units are placed between the gearbox (16) and the top frame (1), and between the overhung load adapter (15) and the top frame (1).

Figure 9A:
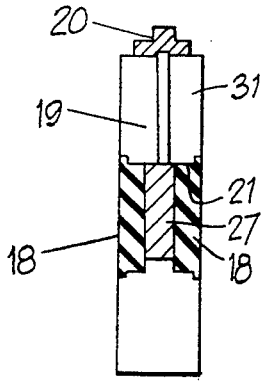
FIG. 9A is a schematic side elevational view of the pressure seal/spacer assembly.
Figure 9B:
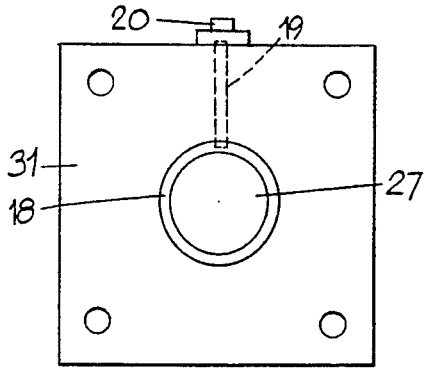
FIG. 9B is a schematic front elevational view of the pressure seal/spacer assembly.

With reference to FIGS. 9A and 9B, each high pressure seal unit (14) is comprised of a thick, square, piece of steel plate (31) in which are drilled boltholes (32) to match those in either the gearbox (16) or the overhung load adapter (15). In the center of the steel plate (31), a large counter-sunk hole (21) is bored, into which two high-pressure seals (18) are pressed, back-to-back. The shaft (27) is shown inserted within the seals (18) in FIGS. 9A and 9B, although the shaft (28) is similarly received. From the side, a small hole (19) is drilled to the large hole (21) in the center of the plate (31). A grease fitting (20) is secured to the plate (31) where the hole (19) exists the side of the plate (31). Grease or oil is injected into the space between the two seals (18) to provide not only lubrication for the seals, but also to improve the dissipation of pressure across the seals.

Figure 1:
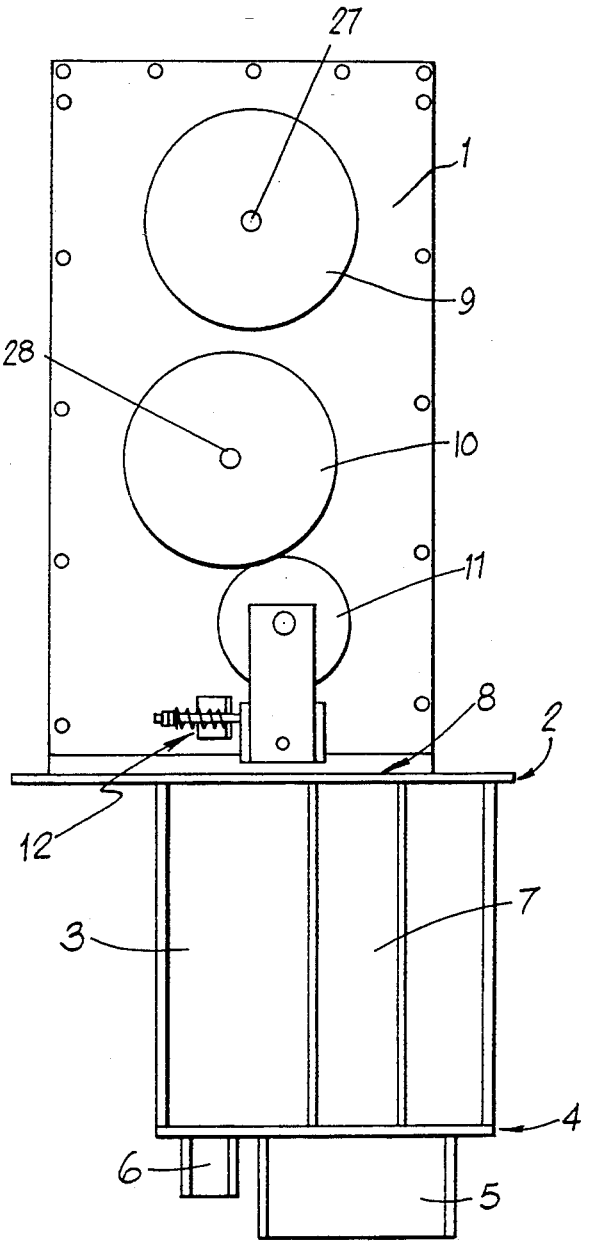
FIG. 1 is a schematic front view of the surface assembly for rope pumps of the present invention with the front cover removed.
Figure 3:
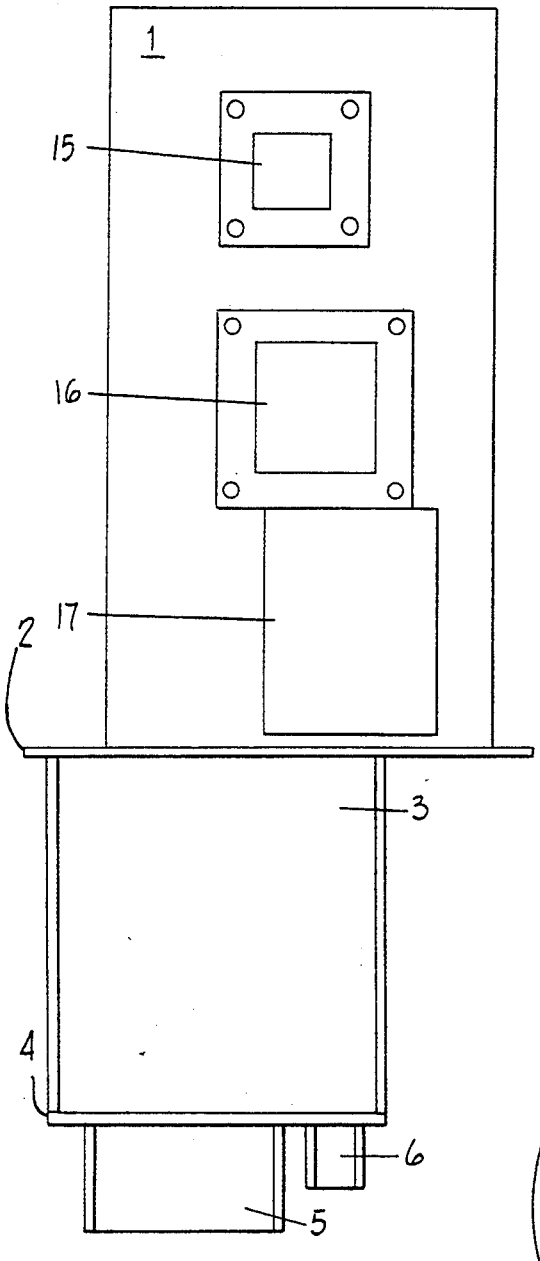
FIG. 3 is a schematic back sectional view of a fully assembled unit.

The integrated reservoir (3) is a downward, vertical extension of the containment vessel (30), being a cylindrical container residing beneath the top frame (1) and top plate (2) and is best viewed in FIGS. 1, 2, and 3. The top plate (2) forms the top of the reservoir (3). The base plate (4) forms the bottom of the reservoir (3). A riser pipe (7) is welded to the base plate (4) and is of sufficient length to extend through a matching hole in the top plate (2). The tubing hanger, tubing, and other downhole equipment is installed into the riser (7). The tubing hanger (not shown) rests in the tubing hanger receiver (8).

The integrated reservoir (3) collects produced fluids. If an external transfer pump (42) is employed, a float switch (40) mounted inside reservoir (3) can be used to cycle that external pump. The improvement of an integrated reservoir (3) has several benefits: a) reduced overall parts count; b) reduced number of plumbing connections; c) reduced opportunities for leaks; and d) fast and easy installation of the surface unit.

Welded to the bottom of the base plate (4) is a threaded coupling (5) The coupling (5) is of a size and thread design to replace the "well nut" on top of an industry-standard tubing wellhead. See FIGS. 1, 2, 3, 8A and 8B.

The integrated wellhead connection allows the installer to install the surface unit in a single procedure. The installer need only screw the entire surface unit onto the tubing wellhead, which is already in place at the well. There is no other connection to make. The surface unit does not touch the ground; it sits atop the wellhead.

Having thus described the improvements comprising this invention, what is claimed is:

1. In a rope pump for conveying fluid-like material from a reservoir to a select location, the rope pump comprising an endless rope, loop forming means for forming the endless rope into a loop extending between the reservoir and the select location and means for driving the endless rope about the loop forming means, the driving means comprising:

first and second sheaves each having a plurality of circumferencial grooves and an axis of rotation;

means for mounting the first and second sheaves for rotation about their respective axes of rotation in a radially spaced relationship with the grooves of the first sheave aligned with the grooves of the second sheave and the respective axes of rotation being in parallel; and rotating means operatively associated with one of the first and second sheaves for rotating the sheave about its axis of rotation, the endless rope being wrapped between the first and second sheaves with the rope extending between and engaging aligned grooves and adjacent groves a select number of times to provide a select tractive force.

2. The rope pump of claim 1 further comprising a tensioner wheel engaging the rope and means for biasing the tensioner wheel against the rope to maintain the rope in constant engagement with the final rope engaging groove of the first and second sheaves.

3. The rope pump of claim 1 further comprising a top frame having a top plate attached to its bottom with an orifice in the top plate through which the rope passes, the top frame having first and second sides with the mounting means mounting the first and second sheaves to the first side of the top frame with the second sheave positioned above the first sheave.

4. The rope pump of claim 3 further comprising a front cover configured to define, along with the top frame, a containment vessel containing the first and second sheaves and means for attaching the front cover to the top frame to define the containment vessel therebetween.

5. The rope pump of claim 4 further comprising means mounting the rotating means outside the containment vessel.

6. The rope pump of claim 4 wherein the mounting means comprises first and second axial shafts with the first axial shaft axially engaging the first sheave and the second axial shaft axially engaging the second sheave and each axial shaft having an end which extends between the first and second sides of the top frame, the rotating means being operatively associated with the first shaft on the second side of the top frame and an overhung load adapter being operatively associated with the second shaft on the second side of the top frame.

7. The rope pump of claim 6 wherein the mounting means further comprises means for forming a seal between the first and second shafts and the top frame to isolate an environment inside the containment vessel from and outside environment.

8. The rope pump of claim 7 wherein the sealing means comprises a plate having mounting holes corresponding to mounting holes on the overhung load adapter and a hole for receiving the second shaft, the sealing means further comprising a pair of high pressure seals pressed into the hole on opposite sides of the plate so as to define a void between the pressure seals and means for filling the void between the pressure seals with a lubricant.

9. The rope pump of claim 3 further comprising means attached to the top plate for coupling the top plate to a wellhead.

10. The rope pump of claim 9 wherein the coupling means comprises an internally threaded cylinder attached to the top plate, the internally threaded cylinder having a select internal diameter for threaded engagement between the threaded cylinder and a wellhead.

11. The rope pump of claim 3 further comprising a collection reservoir attached to the top plate for collecting material moved by the rope pump.

12. The rope pump of claim 11 further comprising a conduit in fluid communication with the collection reservoir and a transfer pump in fluid communication with the conduit for conveying material from the collection reservoir.

13. The rope pump of claim 1 wherein the endless rope is wrapped at least twice between the first and second sheaves.

14. The rope pump of claim 1 wherein the endless rope is wrapped at least three times between the first and second sheaves.

15. The rope pump of claim 1 wherein the endless rope is wrapped at least four times between the first and second sheaves.

16. The rope pump of claim 1 wherein the endless rope is wrapped at least five times between the first and second sheaves.

17. A rope pump for conveying petroleum from an underground reservoir to a select surface location through a well bore, the rope pump comprising:

an endless rope;

loop forming means for forming the endless rope into a loop extending between the reservoir and the select surface location;

first and second sheaves each having a plurality of circumferencial grooves and an axis of rotation;

means for mounting the first and second sheaves for rotation about their respective axes of rotation in a radially spaced relationship with the grooves of the first sheave aligned with the grooves of the second sheave and the respective axes of rotation being in parallel; and rotating means operatively associated with one of the first and second sheaves for rotating the sheave about its axis of rotation, the endless rope being wrapped between the first and second sheaves with the rope extending between and engaging aligned grooves and adjacent groves a select number of times to provide a select tractive force.

* * * * *